United States Patent [19]

Stolte

[11] 4,155,028

[45] May 15, 1979

[54] ELECTROSTATIC DEFLECTION SYSTEM FOR EXTENDING EMITTER LIFE

[75] Inventor: Charles A. Stolte, Los Altos, Calif.

[73] Assignee: Hewlett-Packard Company, Palo Alto, Calif.

[21] Appl. No.: 887,695

[22] Filed: Mar. 17, 1978

Related U.S. Application Data

[63] Continuation of Ser. No. 779,209, Mar. 18, 1977, abandoned, which is a continuation of Ser. No. 628,690, Nov. 3, 1975, abandoned.

[51] Int. Cl.[2] ..... H01J 29/82; H01J 29/84

[52] U.S. Cl. ..... 315/14; 313/424; 313/445

[58] Field of Search ..... 313/424, 445, 448; 315/17, 14

[56] References Cited

U.S. PATENT DOCUMENTS

| | | | |
|---|---|---|---|
| 2,496,127 | 1/1950 | Kelar | 313/424 X |
| 2,771,564 | 11/1956 | Hensel | 313/424 |
| 2,835,837 | 5/1958 | Bas-Taymas | 313/424 |

*Primary Examiner*—Robert Segal

*Attorney, Agent, or Firm*—Ronald E. Grubman

[57] ABSTRACT

An electrostatic beam deflection system is provided for use in electron beam devices. In the present system several grids and an accelerating electrode are geometrically configured to direct positive ions away from an electron emitter surface. These positive ions are typically formed by interaction of the electrons emitted from the emitter surface with a gas ambient or with species adsorbed on the various grids and electrodes. Degradation of the electron emitter surface is thereby reduced, and the lifetime of the emitter concomitantly extended.

1 Claim, 1 Drawing Figure

ELECTROSTATIC DEFLECTION SYSTEM FOR EXTENDING EMITTER LIFE

This is a continuation of application Ser. No. 779,209 filed Mar. 18, 1977, now abandoned, which was a continuation of application Ser. No. 628,690 filed Nov. 3, 1975, also abandoned.

BACKGROUND OF THE INVENTION

In electronic devices employing electron emitters it has been a problem to maintain the integrity of the emitter surface. A major factor degrading the surface, and hence the lifetime of the device, is the return to the emitting surface of positive ions generated by the interaction of the electron beam with the residual gas in the inter-electrode spaces, and by ionic desorption from electrode and grid surfaces. These positive ions are accelerated toward the surface by the same electric field which accelerates the emitted electrons. As a consequence, the operating life of the emitter is reduced by processes such as contamination of the surface by the ion species, sputter removal of the emitting material, chemical doping of the emitting material by ion implantation, and other physical damage to the emitting surface from ion impact. The surface degradation is of particular importance in connection with negative electron affinity electron emission devices such as the junction, secondary emission devices, and photoemission devices.

Solutions suggested in the prior art have included attempts to improve the vacuum between the electrodes, introduction of methods for cleaning the electrode surface, and replenishment of the electron emitting surface as degradation occurs. It is also known to employ combined electric and magnetic fields to separate the electron and ion trajectories based on the large differences in mass between the two species. However, this technique requires the application of external magnetic fields and presents additional beam formation and deflection problems.

SUMMARY OF THE INVENTION

In accordance with the illustrated preferred embodiments, the present invention provides an electrostatic beam deflection system which precludes the bombardment of the emitting surface by the beam generated positive ions. The invention employs a first grid to accelerate emitted electrons directionally away from the emitter surface. This first grid is biased to accelerate the electrons only to an energy below the threshold energy for ionization in the gas ambient. A second grid is positioned at an angle to the first grid and is preferably operated at substantially the same potential as the first grid. The low energy electron beam therefore traverses a substantially field free region between the two grids. An accelerating electrode is positioned beyond the second grid, and is biased to accelerate the electrons to a higher energy, which may be the desired final beam energy. Positive ions are generated by the high energy electron beam in the region beyond the second grid and the accelerating electrode, but these ions are accelerated by the accelerating electrode and pass into the field free region where they drift along trajectories which do not impact the electron emitting surface.

DESCRIPTION OF THE PREFERRED EMBODIMENT

Figure 1:
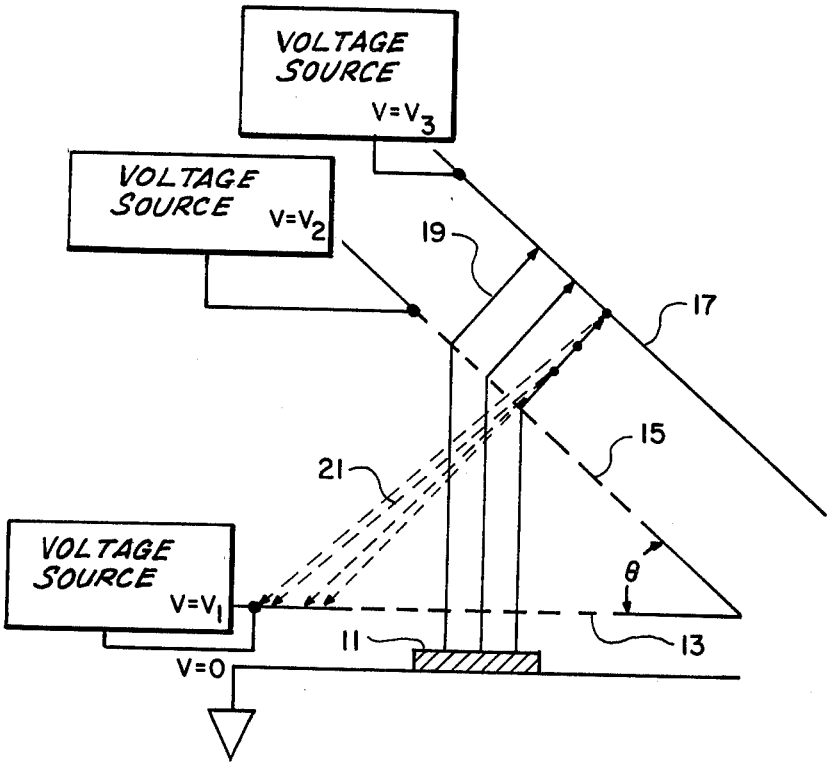
FIG. 1 illustrates a preferred embodiment of an electrostatic deflection system.

In FIG. 1 there is illustrated an electron emitter surface 11. For purposes of reference, emitter 11 is indicated as being biased to a voltage $V=0$. Electrons are emitted from surface 11 by any of a number of processes exemplified by thermionic emission, secondary emission, photoelectric emission or cold cathode emission of electrically injection electrons.

A first grid 13 is illustrated as being biased to a voltage $V=V_1$, where $V_1$ is greater than 0 but below the threshold for ion generation by either ambient gas ionization in the inter-electrode region or surface ion desorption. In an exemplary system wherein the ambient gas is $H_2$ at a pressure of about $10^{-7}$ Torr and the electron emitter surface 11 is of cesiated GaAs, a voltage $V_1$ in the range 5 V to 10 V has been utilized. Grid 13 serves to accelerate emitted electrons away from surface 11. The distance between emitter surface 11 and grid 13 may be selected to produce a particular required electron beam current. For example, in the system described above ($V_1=10$ V) a distance of about 0.025 cm has produced an electron beam current density of about 0.01 A/cm$^2$.

A second grid 15 is positioned at an angle to grid 13, the angle being designated as "$\theta$" in FIG. 1. Grid 15 is preferably biased to a voltage $V_2=V_1$ to provide a field free region between the two grids. (As will be explained more fully below, grids 13 and 15 may also be operated at differing potentials, with perhaps some resulting spatial spread of the electron beam.) Electrons passing through grid 13 drift through the field free region at relatively low velocity. After passing through grid 15 the electrons encounter an electric field established by an accelerating electrode 17 which is biased to a potential $V_3(V_3>V_2)$.

The path of electrons emitted from surface 11 is indicated by a number of solid arrows, a representative one of which is labeled 19 in FIG. 1. In the region between grid 15 and electrode 17 the electrons will typically be accelerated to a sufficiently high energy to interact with the ambient gas and/or adsorbed surface species to produce free positive ions. In prior art devices such positive ions would be attracted to the emitting electrode and degrade its surface. In the present invention, however, the positive ions are accelerated in the region between grid 15 and electrode 17 and are passed through grid 15 into the field free region. If voltage $V_3$ on accelerating electrode 17 is sufficiently high, most of these positive ions will have velocities substantially perpendicular to grid 15 and will therefore drift through the field free region in directions such as are exemplified by the dotted arrows labeled 21. Thus, the angle $\theta$ between grids 13 and 15 may be selected in conjunction with accelerating voltage $V_3$ to insure that the majority of the positive ions will follow trajectories away from emitter surface 11, and hence not impact that surface. In the system above described, $V_2=720$ V and an angle $\theta=45°$ have been used to provide the desired ion trajectories away from emitter surface 11.

It should be noted that if a convenient value of $V_3$ is insufficient to produce a desired final electron beam energy, then electrode 17 may be replaced by an accelerating grid, and additional electrodes utilized to achieve the final beam energy.

It will be evident to those skilled in the art that the various voltages and geometric specifications described herein are only representative of configurations which will achieve the desired results. For example, as mentioned above, voltage $V_2$ may be selected to be different from $V_1$ (e.g. more positive). In this case the region between grids 13 and 15 will not be field free, and the electron trajectories 19 will be curved toward grid 15. Similarly, the ion trajectories 21 will tend to curve toward grid 13. However, by adjusting voltage $V_3$ and angle $\theta$, there may still be imparted to the positive ions a sufficient acceleration that the ion trajectories will not impact emitter surface 11. Preservation of the emitter surface is again obtained in accordance with the principles disclosed herein.

I claim:

1. An electron emitting device comprising:

an emitter having a surface for emitting electrons therefrom;

first and second grids positioned with a predetermined angle between them, and biasing means for electrically biasing said first and second grids to substantially the same potential to establish a substantially field-free region therebetween, said potential being of sufficient magnitude to accelerate electrons from said emitter into said substantially field-free region, but insufficient to impart energies to the electrons which would allow production of positive ions in said substantially field-free region;

an accelerating electrode positioned in spatial and parallel relation to said second grid to provide an accelerating region therebetween; and associated biasing means for electrically biasing said accelerating electrode to another potential higher than the potential of said first and second grids;

said predetermined angle being selected to insure that any positive ions formed in said accelerating region and accelerated into said substantially field-free region will be directed away from said emitter surface.

* * * * *